US006108834A

United States Patent [19]

Mauro et al.

[11] Patent Number: 6,108,834

[45] Date of Patent: Aug. 29, 2000

[54] UNITARY BODY BEDDING FOUNDATION

[75] Inventors: Frank Mauro, Brampton; Fausto Mauro, Woodbridge; Vito Mauro, Brampton, all of Canada

[73] Assignee: International Sleep Creations, Inc., Toronto, Canada

[21] Appl. No.: 09/390,505

[22] Filed: Sep. 3, 1999

Related U.S. Application Data

[63] Continuation-in-part of application No. 08/816,516, Mar. 13, 1997, Pat. No. 5,953,775.

[51] Int. Cl.[7] ..... A47C 23/00; A47C 23/02

[52] U.S. Cl. ..... 5/246; 5/263; 267/103

[58] Field of Search ..... 5/246, 245, 247, 5/248, 263; 267/103

[56] References Cited

U.S. PATENT DOCUMENTS

| | | | |
|---|---|---|---|
| D. 316,202 | 4/1991 | Farley | D6/596 |
| 2,924,830 | 2/1960 | De Long . | |
| 3,049,729 | 8/1962 | Broyles . | |
| 3,083,380 | 4/1963 | Adler . | |
| 3,656,193 | 4/1972 | Schneider et al. | 5/655 |
| 3,815,165 | 6/1974 | Tobinick et al. . | |
| 4,100,631 | 7/1978 | Slone | 5/248 |
| 4,128,907 | 12/1978 | Gelbart | 5/201 |
| 4,181,991 | 1/1980 | Morgan et al. | 5/239 |
| 4,535,494 | 8/1985 | Diamonstein | 5/400 |
| 4,867,424 | 9/1989 | Dabney | 5/246 |
| 4,870,711 | 10/1989 | Felix | 5/201 |
| 4,970,743 | 11/1990 | Wride et al. | 5/201 |
| 5,052,064 | 10/1991 | Hagemeister et al. | 5/246 |
| 5,144,706 | 9/1992 | Walker | 5/400 |
| 5,231,714 | 8/1993 | Mossbeck | 5/400 |
| 5,469,589 | 11/1995 | Steed et al. . | |

FOREIGN PATENT DOCUMENTS

| | | |
|---|---|---|
| 2 547 185 | 6/1983 | France . |

*Primary Examiner*—Alexander Grosz

[57] ABSTRACT

A unitary base member for supporting a wire spring assembly of a bed foundation. The base member includes a lattice formed of a plurality of lateral members and a plurality of longitudinal members. The lattice has a lower surface and an upper surface for mounting a wire spring assembly thereon. The lateral members are oriented substantially parallel to each other, and the longitudinal members are oriented substantially parallel to each other. The plurality of lateral members are positioned above said plurality of longitudinal members. Significantly, the lateral and longitudinal members of the lattice are integrally and inseparably formed together with each other as a single piece of substantially rigid plastic for preventing movement of the members with respect to each other.

8 Claims, 5 Drawing Sheets

UNITARY BODY BEDDING FOUNDATION

CROSS REFERENCE TO RELATED APPLICATIONS

This application is a continuation-in-part application of our utility application filed Mar. 13, 1997 and assigned the application number 08/816,516 now U.S. Pat. No. 5,953,775.

BACKGROUND OF THE INVENTION

1. Field of the Invention

The present invention relates to bedding foundations or bed frames and more particularly pertains to a new unitary body bedding foundation for constructing the top deck portion, the end walls and the side walls are all as a single piece.

2. Description of the Prior Art

Bedding foundations or box springs frames have traditionally been manufactured using wood and wood by-products. Once the main structural box is completed, a fabric cover is added to conceal open areas and to match the fabric of the supported mattress. A manufacturer using wood as a material is constantly faced with the prospects of rising prices, decreasing supply and the risk of using inferior grades of wood. A plastic bedding foundation can be made as a single unit and solves the problems of using wood for bedding foundations.

The use of bedding foundations is known in the prior art. More specifically, bedding foundations heretofore devised and utilized are known to consist basically of familiar, expected and obvious structural configurations, notwithstanding the myriad of designs encompassed by the crowded prior art which have been developed for the fulfillment of countless objectives and requirements.

Known prior art bedding foundations include U.S. Pat. No. 4,870,711; U.S. Pat. No. 4,535,494; U.S. Pat. Des. No. 316,202; U.S. Pat. No. 5,144,706; U.S. Pat. No. 5,231,714; and U.S. Pat. 4,181,991.

While these devices fulfill their respective, particular objectives and requirements, the aforementioned patents do not disclose a new unitary body bedding foundation. The inventive device includes a top deck member having two spaced apart side walls and two spaced apart end walls on its bottom face. The side walls and the end walls may designed to be detachable from the top deck member. To aid in supporting the top deck member, the unitary body bed foundation may also include a support frame member adjacent the bottom face of the top deck member. The support frame member can be either a lattice support frame member having a plurality of longitudinal and latitudinal intersecting ribs included on the bottom face, or at least one lateral slat extended transversely between the two side walls and the ends of each lateral slat being accepted by a slat brace on each of the side walls.

In these respects, the unitary body bedding foundation according to the present invention substantially departs from the conventional concepts and designs of the prior art, and in so doing provides an apparatus primarily developed for the purpose of constructing the top deck portion, the end walls and the side walls are all as a single piece.

SUMMARY OF THE INVENTION

In view of the foregoing disadvantages inherent in the known types of bedding foundations now present in the prior art, the present invention provides a new unitary body bedding foundation construction wherein the same can be utilized for constructing the top deck portion, the end walls and the side walls are all as a single piece.

The general purpose of the present invention, which will be described subsequently in greater detail, is to provide a new unitary body bedding foundation apparatus and method which has many of the advantages of the bedding foundations mentioned heretofore and many novel features that result in a new unitary body bedding foundation which is not anticipated, rendered obvious, suggested, or even implied by any of the prior art bedding foundations, either alone or in any combination thereof.

To attain this, the present invention generally comprises a top deck member having two spaced apart side walls and two spaced apart end walls on its bottom face. The side walls and the end walls may designed to be detachable from the top deck member. To aid in supporting the top deck member, the unitary body bed foundation may also include a support frame member adjacent the bottom face of the top deck member. The support frame member can be either a lattice support frame member having a plurality of longitudinal and latitudinal intersecting ribs included on the bottom face, or at least one lateral slat extended transversely between the two side walls and the ends of each lateral slat being accepted by a slat brace on each of the side walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new unitary body bedding foundation apparatus and method which has many of the advantages of the bedding foundations mentioned heretofore and many novel features that result in a new unitary body bedding foundation which is not anticipated, rendered obvious, suggested, or even implied by any of the prior art bedding foundations, either alone or in any combination thereof.

It is another object of the present invention to provide a new unitary body bedding foundation which may be easily and efficiently manufactured and marketed.

It is a further object of the present invention to provide a new unitary body bedding foundation which is of a durable and reliable construction.

An even further object of the present invention is to provide a new unitary body bedding foundation which is susceptible of a low cost of manufacture with regard to both materials and labor, and which accordingly is then susceptible of low prices of sale to the consuming public, thereby making such unitary body bedding foundation economically available to the buying public.

Still yet another object of the present invention is to provide a new unitary body bedding foundation which provides in the apparatuses and methods of the prior art some of the advantages thereof, while simultaneously overcoming some of the disadvantages normally associated therewith.

Still another object of the present invention is to provide a new unitary body bedding foundation for constructing the top deck portion, the end walls and the side walls are all as a single piece.

Yet another object of the present invention is to provide a new unitary body bedding foundation which includes a top deck member having two spaced apart side walls and two spaced apart end walls on its bottom face. The side walls and the end walls may designed to be detachable from the top deck member. To aid in supporting the top deck member, the unitary body bed foundation may also include a support frame member adjacent the bottom face of the top deck member. The support frame member can be either a lattice support frame member having a plurality of longitudinal and latitudinal intersecting ribs included on the bottom face, or at least one lateral slat extended transversely between the two side walls and the ends of each lateral slat being accepted by a slat brace on each of the side walls.

Still yet another object of the present invention is to provide a new unitary body bedding foundation that is constructed out of a combination of new and recycled plastic rather than the traditional wood foundation so that it does not creak, and is unaffected by moisture, and its structural strength is not weakened through use unlike the traditional wood bed foundation.

Even still another object of the present invention is to provide a new unitary body bedding foundation that is constructed so that it may be dismantled for shipping in more convenient packaging.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
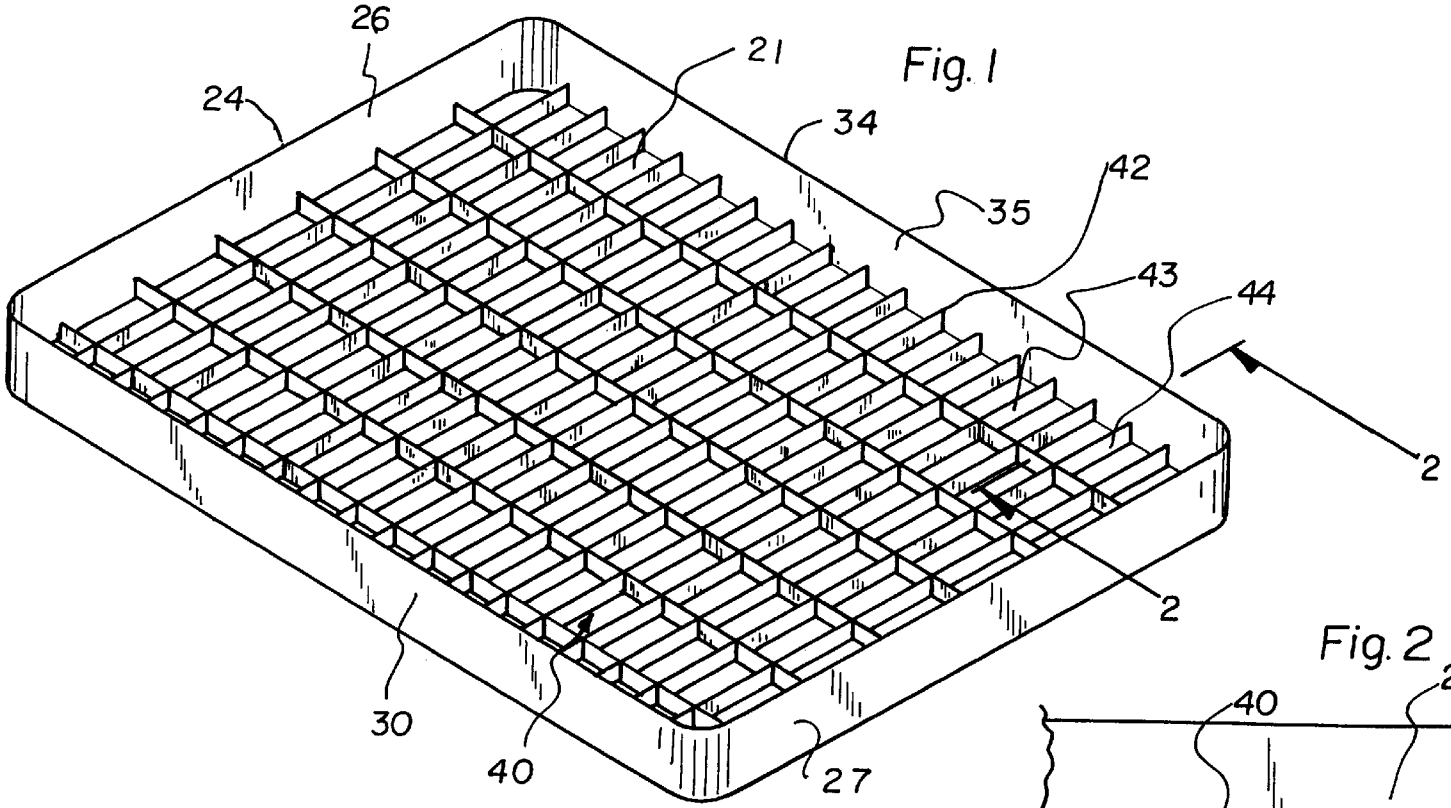
FIG. 1 is a bottom perspective view of a new unitary body bedding foundation according to the present invention showing the optional lattice support frame member.
Figure 2:
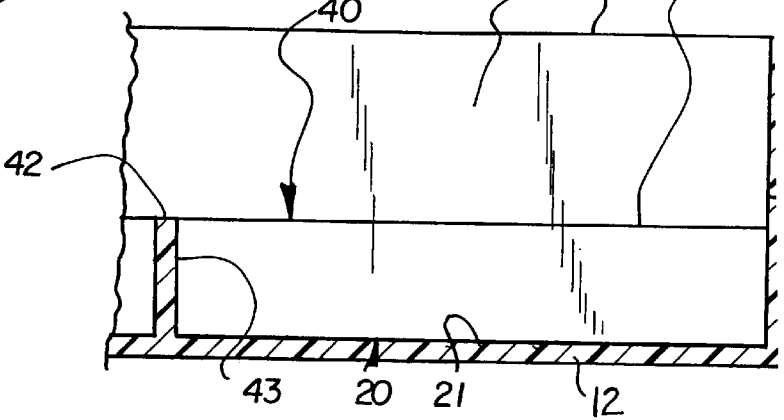
FIG. 2 is a partial cross-sectional view of the present invention taken along line 2—2 of FIG. 1.
Figure 4:
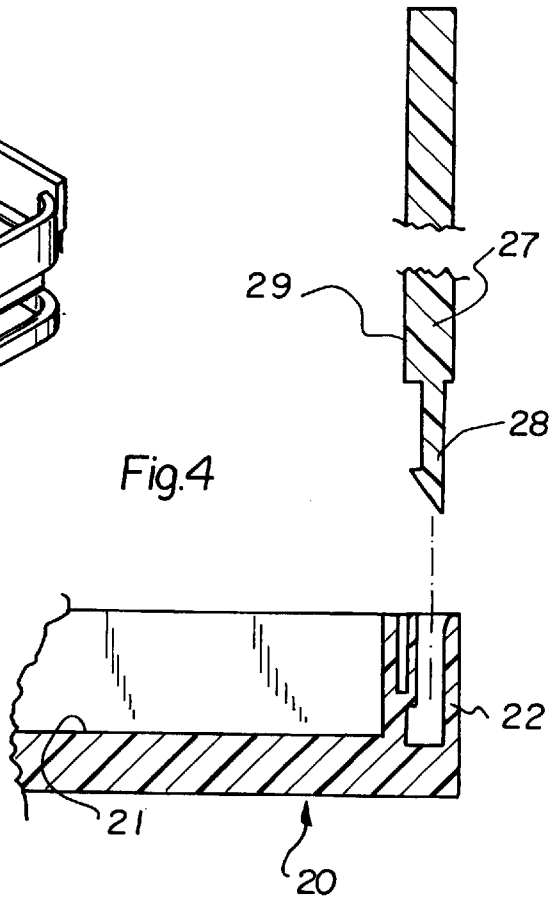
FIG. 4 is a partial cross-sectional view taken from line 4—4 of FIG. 3 showing the detail of the insertion of the top deck attachment portion into the side wall slot of the top deck member.

With reference now to the drawings, and in particular to FIGS. 1 through 10 thereof, a new unitary body bedding foundation embodying the principles and concepts of the present invention and generally designated by the reference numeral 10 will be described.

As best illustrated in FIGS. 1 through 10, the unitary body bedding foundation 10 comprises a rectangular shaped top deck member 12 that can be made to any dimension. The top deck member 12 is designed to be of sufficient size so it can support a mattress upon it. On the outer perimeter of its bottom face 21 are a pair of similarly aligned and spaced apart side walls 30, 34 and a pair of similarly aligned and spaced apart end walls 24, 27.

Figure 3:
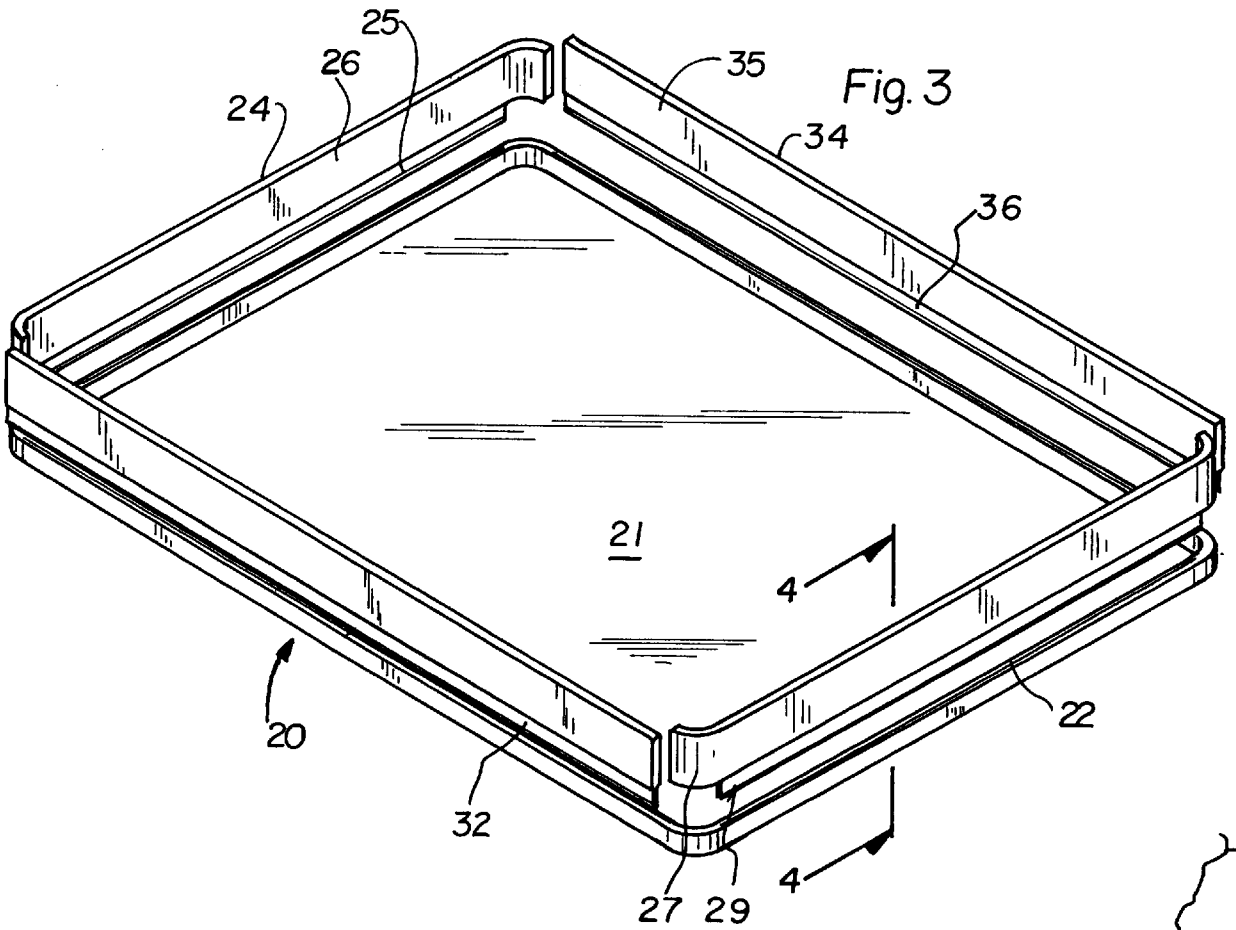
FIG. 3 is a exploded perspective view of the present invention having optional detachable side walls and end walls.

In FIG. 1, the end walls 24, 27 and the side walls 30, 34 are designed as an integral part of the top deck member 20. Optionally as shown in FIG. 3, the side walls 30, 34 and the end walls 24, 27 may be detachable from the top deck member 10. In this embodiment of the invention, each of the side walls 30, 34 includes a top deck attachment portion 32, 36 extending along its length. Similarly, each of the end walls 24, 27 has a top deck attachment portion 25, 28 extending along its length. Correspondingly, the top deck member 20 has a side wall attachment slot or slots 22 extending around the outer perimeter of its bottom face 21. The top deck attachment portions 25, 28, 32, 36 are inserted into and accepted by the attachment slot or slots 22 at the top deck attachment portions' 25, 28, 32, 36 respective position on the bottom face 21.

Figures 5, 6:
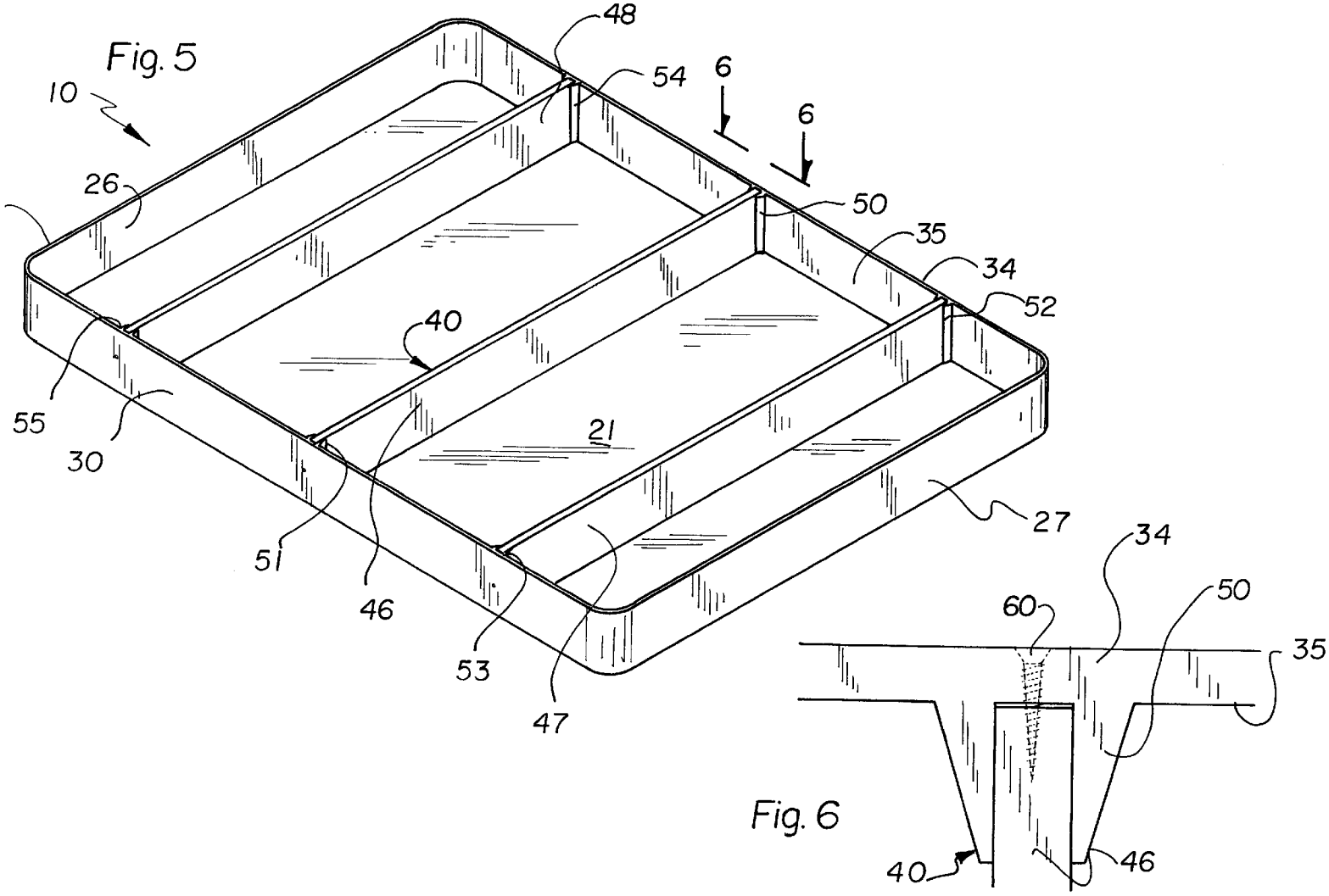
FIG. 5 is a perspective view of the showing an optional embodiment of the unitary body bed foundation with lateral slats extending transversely between the side walls.
FIG. 6 is a partial sectional view showing the relationship of the slat brace and the end of a lateral slat as seen from line 6—6 on FIG. 5.
Figure 7:
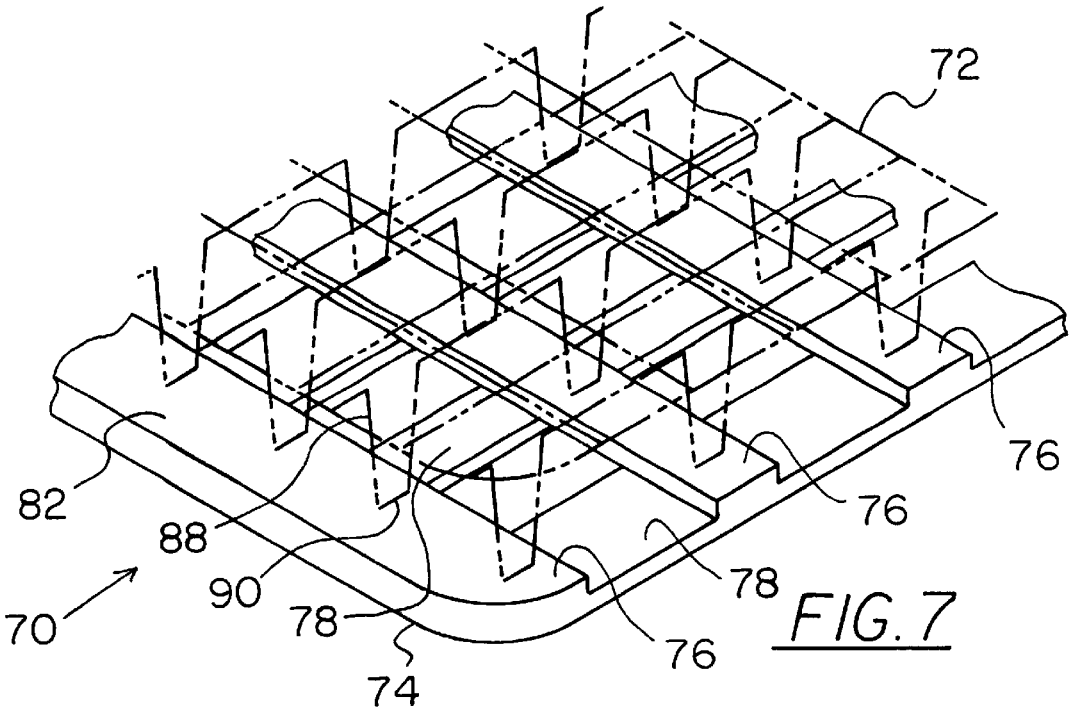
FIG. 7 is an upper perspective view of a broken away partial portion of an optional embodiment of the invention particularly showing the relationship of a base member to a wire spring assembly.
Figure 8:
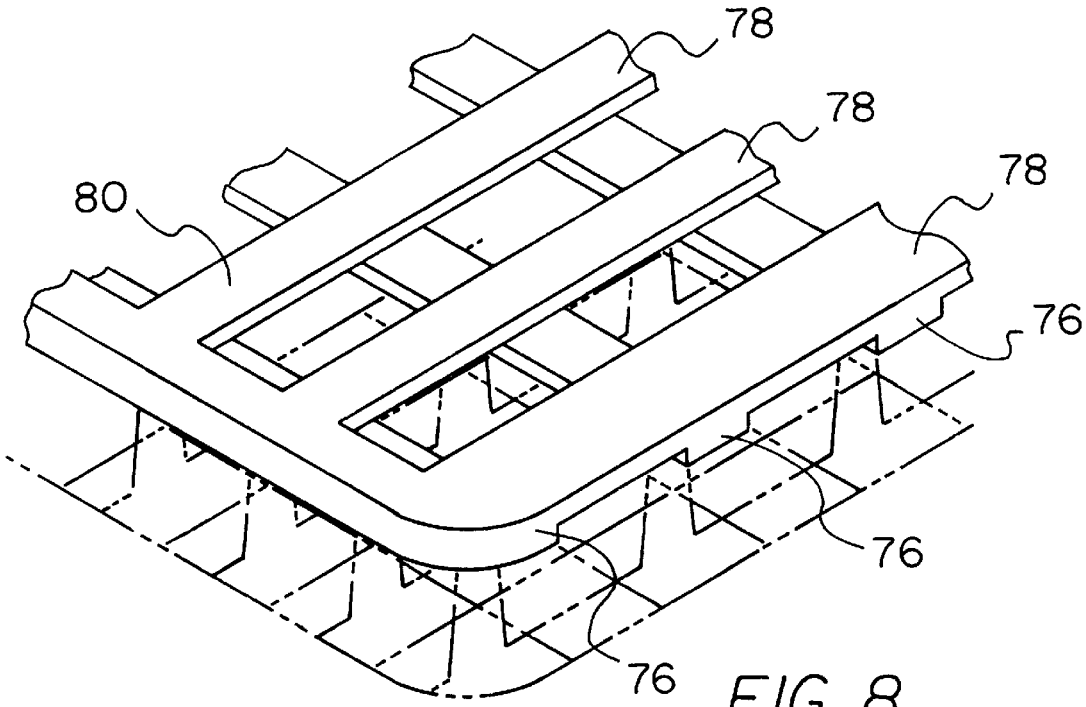
FIG. 8 is a lower perspective view of a broken away partial portion of the optional embodiment of the invention.
Figure 9:
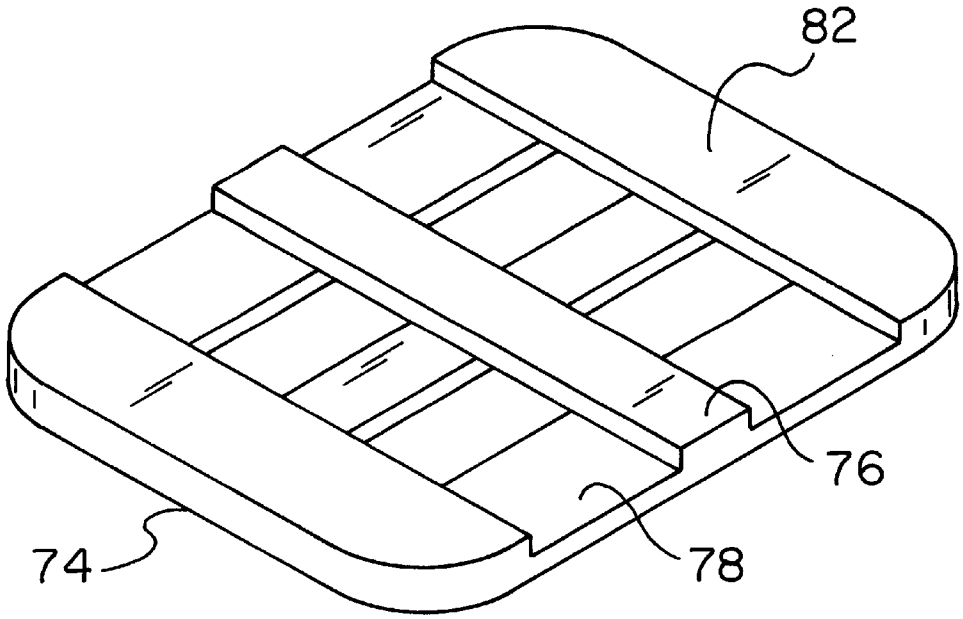
FIG. 9 is an upper perspective view of a miniaturized structure of the optional embodiment.
Figure 10:
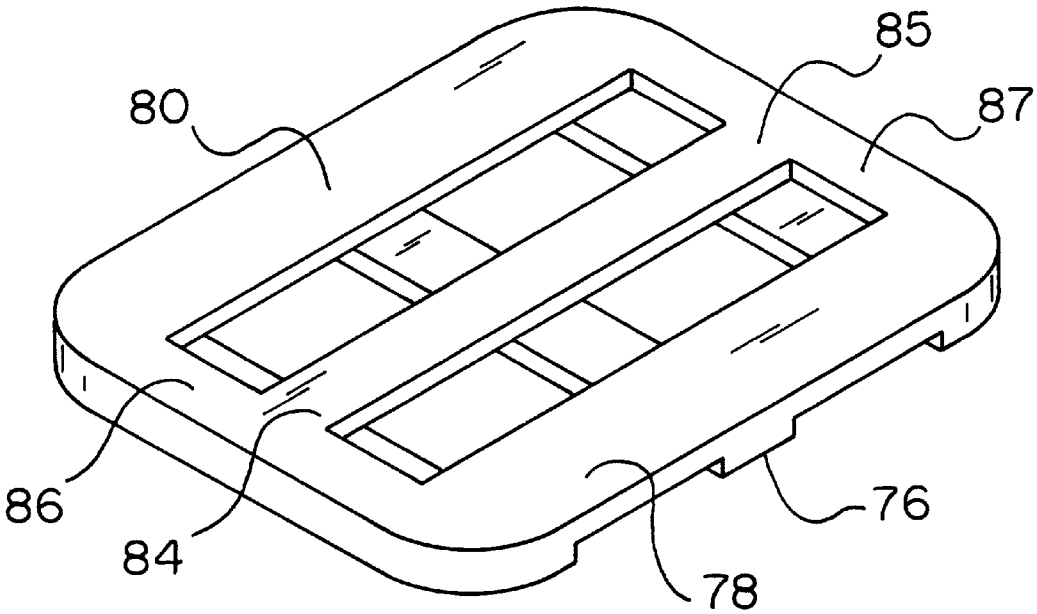
FIG. 10 is a lower perspective view of the miniaturized structure of the optional embodiment.

The top deck member 20 may be designed to be of sufficient thickness to support a mattress on its top face (not shown) on its own. However, as shown in FIGS. 1 and 5, a support frame member 40 positioned adjacent the bottom face 21 to provide additional strength and support to the top deck member 20.

As shown in FIG. 1, one embodiment of the unitary body bed foundation 10 has a support frame member 40 comprising a lattice support frame member 42 included as integral part of the bottom face 21 of the top deck member 20. The lattice support frame member 42 is comprised of a plurality of spaced apart longitudinal rib members 43 being intersected by a plurality of spaced apart latitudinal rib members 44. The lateral rib members 44 extend transversely between the interior faces 35 of the side walls 30, 34 while the longitudinal rib members 43 extend transversely between the interior faces 26, 29 of the end walls 24, 27.

Another optional variant of support frame member 40 comprises at least one lateral slat 46, 47, 48 where each lateral slat 46, 47, 48 is positioned adjacent to the bottom face 21 of the top deck member 20 and extended transversely between the side walls 30, 34 so each of its ends is adjacent one of the interior faces 35 of the side walls 30, 34. On each of the interior faces 35 of the side walls 30, 34 there is a U-shaped slat brace 50, 51, 52, 53, 54, 55 for each lateral slat 46, 47, 48. As shown in FIG. 5, the slat braces 51, 53, 55 on one side wall 30 may be in alignment with their corresponding slat brace 50, 52, 54 on the other side wall 34. Each slat brace 50, 51, 52, 53, 54, 55 accepts one end of each lateral slat 46, 47, 48 so that the slats 46, 47, 48 are attached to the side walls 30, 34. For further strength and stability, the ends of each lateral slat 46, 47, 48 may be coupled to its respective slat braces 50, 51, 52, 53, 54, 55 and the side walls 30, 34 by a fastener 60 such as a threaded screw.

In manufacturing the unitary body bed foundation 10, the top deck member 20, the side walls 30, 34, the end walls 24, 27, the support frame member 40, and the lattice support frame member 42 may be made of plastic. As an example, the plastic may be made of a combination of polyolefins, linear low density polyethylene, low density polyethylene, high density polyethylene, polypropylene, polyethylene terephthalate. The plastics may also be a combination of virgin plastics and recycled plastics. The plastic may also include other additives such as fire retardants, stabilizers, and color pigments. The elements of the unitary body bed foundation 10 may be manufactured using compression molding, injection molding or thermoforming. Additionally, the lateral slats 46, 47, 48 may be made of metal, wood or of plastic as described above.

A highly preferred optional embodiment of the bed foundation 70 of the invention (shown in FIGS. 7 through 10) comprises a wire spring assembly 72 and a base member 74 adapted for supporting the wire spring assembly 72. The base member 74 comprises a lattice formed of a plurality of lateral members 76 and a plurality of longitudinal members 78. The lattice has a lower surface 80 and an upper surface 82. The wire spring assembly 72 is mounted on the upper surface 82 of the lattice. The lateral members 76 may be oriented substantially parallel to each other, and the lateral members 76 may be spaced substantially uniformly from each other. Similarly, the longitudinal members 78 may be oriented substantially parallel to each other, and the longitudinal members may be spaced substantially uniformly from each other. The plurality of lateral members 76 may be positioned above the plurality of longitudinal members. The plurality of lateral members 76 form a plurality of laterally extending slots in the upper surface 82 of the lattice. The plurality of longitudinal members 78 form a plurality of longitudinally extending slots in the lower surface 80 of the lattice. Preferably, the longitudinal slots have a width in the lateral direction that is substantially the same as the width in the lateral direction of the longitudinal members. Similarly, the lateral slots preferably have a width in the longitudinal direction that is substantially the same as the width in the longitudinal direction of the lateral members.

The longitudinal members 78 each have opposite ends 84, 85. An end member 86, 87 extends laterally along and joining the ends 84, 85 of the longitudinal members 78. The laterally-outermost longitudinal members and the end members 86, 87 form a continuous flat perimeter surface on the lower surface, which is highly suitable for resting on a support structure such as a bed frame. Each of the end members 86, 87 preferably extends beneath one of the lateral members 76 located above the end member to form a thickness of the base member at the longitudinal ends that is a combination of the thicknesses of a lateral and an end member.

Each of the lateral 76 and longitudinal 78 members preferably has a uniform cross-sectional shape along substantially its entire length. Each of the lateral and longitudinal members have a thickness, and the thicknesses of the lateral and the longitudinal members are substantially equal.

Significantly, the lateral and longitudinal members of the lattice of the base member are integrally and inseparably formed together as a single piece of substantially rigid plastic. The plastic base member provides a rigid base for mounting the flexible and compressible wire spring assembly.

The wire spring assembly 72 comprises a plurality of generally V-shaped wire portions 88 each having an apex. The apex 90 of each V-shaped wire portions 88 is mounted to a location on the upper surface of one of the lateral members 76 such that the wire spring assembly 72 is raised above the longitudinal members 78. The wire spring assembly 72 and the base member 74 may be shrouded with appropriate padding and fabric.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A base member for supporting a wire spring assembly of a bed foundation, comprising:

a lattice formed of a plurality of lateral members and a plurality of longitudinal members, said lattice having a lower surface and an upper surface for mounting a wire spring assembly thereon, said lateral members being oriented substantially parallel to each other, said longitudinal members being oriented substantially parallel to each other, said plurality of lateral members being positioned above said plurality of longitudinal members, wherein said lateral and longitudinal members of said lattice are integrally and inseparably formed together with each other as a single piece of substantially rigid plastic for preventing movement of the members with respect to each other.

2. The base member of claim 1 wherein said longitudinal members each have opposite ends, and said base member additionally comprises an end member extending laterally along and joining said ends of said longitudinal members.

3. The base member of claim 2 wherein laterally-outermost ones of said longitudinal members and said end members form a continuous flat perimeter surface on said lower surface.

4. The base member of claim 1 wherein said lateral members are spaced substantially uniformly from each other and said longitudinal members are spaced substantially uniformly from each other.

5. The base member of claim 4 wherein said plurality of lateral members form a plurality of laterally extending slots in said upper surface of said lattice, and said plurality of longitudinal members form a plurality of longitudinally extending slots in said lower surface of said lattice.

6. The base member of claim 1 wherein each of said lateral and longitudinal members has a uniform cross-sectional shape along substantially its entire length.

7. The base member of claim 1 wherein each of said lateral and longitudinal members have a thickness, and wherein said thicknesses of said lateral and longitudinal members are substantially equal.

8. A bed foundation, comprising:

a wire spring assembly; and a base member for supporting said wire spring assembly;

wherein said base member comprises a lattice formed of a plurality of lateral members and a plurality of longitudinal members, said lattice having a lower surface and an upper surface having said wire spring assembly mounted thereon, said lateral members being oriented substantially parallel to each other, said lateral members being spaced substantially uniformly from each other, said longitudinal members being oriented substantially parallel to each other, said longitudinal members being spaced substantially uniformly from each other, said plurality of lateral members being positioned above said plurality of longitudinal members, said plurality of lateral members forming a plurality of laterally extending slots in said upper surface of said lattice, said plurality of longitudinal members forming a plurality of longitudinally extending slots in said lower surface of said lattice, wherein said longitudinal members each have opposite ends, and an end member extending laterally along and joining said ends of said longitudinal members, wherein said laterally-outermost longitudinal members and said end members form a continuous flat perimeter surface on said lower surface, each of said end members extending beneath one of said lateral members located above said end member, wherein each of said lateral and longitudinal members has a uniform cross-sectional shape along substantially its entire length, wherein each of said lateral and longitudinal members have a thickness, and wherein said thicknesses of said lateral and longitudinal members are substantially equal, wherein said lateral and longitudinal members of said lattice are integrally and inseparably formed together as a single piece of substantially rigid plastic, and wherein said wire spring assembly comprises a plurality of generally V-shaped wire portions having an apex, said apex of each V-shaped wire portions being mounted to a location on said upper surface of one of said lateral members such that said wire spring assembly is raised above said longitudinal members.

* * * * *